US007540175B2

(12) United States Patent
Kalous et al.

(10) Patent No.: US 7,540,175 B2
(45) Date of Patent: Jun. 2, 2009

(54) MOUNTABLE SAFE

(75) Inventors: D. Scott Kalous, Kenosha, WI (US); Steve Hedlund, Racine, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/930,200

(22) Filed: Oct. 31, 2007

(65) Prior Publication Data

US 2008/0098939 A1 May 1, 2008

Related U.S. Application Data

(60) Provisional application No. 60/855,478, filed on Oct. 31, 2006, provisional application No. 60/855,670, filed on Oct. 31, 2006.

(51) Int. Cl.
*E05B 65/52* (2006.01)

(52) U.S. Cl. ..... 70/63; 70/34; 70/258; 109/50; 248/553

(58) Field of Classification Search ..... 70/63, 70/34, 158, 163–173, 258, 466, DIG. 81; 109/50–52; 248/551–553; 280/507
See application file for complete search history.

(56) References Cited

U.S. PATENT DOCUMENTS

| | | | | | |
|---|---|---|---|---|---|
| 824,913 | A * | 7/1906 | Cumming | 215/207 |
| 1,261,046 | A * | 4/1918 | McNamee | 109/47 |
| 1,885,692 | A * | 11/1932 | Dugan | 40/660 |
| 2,046,831 | A * | 7/1936 | Lowe | 70/369 |
| 3,782,761 | A * | 1/1974 | Cardin, Sr. | 280/507 |
| 4,325,237 | A * | 4/1982 | Menzie | 70/14 |
| 4,829,796 | A * | 5/1989 | Kim | 70/168 |
| 5,060,491 | A * | 10/1991 | Smith | 70/63 |
| 5,156,030 | A * | 10/1992 | Hill et al. | 70/63 |
| 5,212,972 | A * | 5/1993 | Kincaid et al. | 70/208 |
| 5,595,073 | A * | 1/1997 | Sullivan | 70/18 |
| 5,692,721 | A * | 12/1997 | Roberts | 248/551 |
| 5,953,940 | A * | 9/1999 | Ling | 70/25 |
| 6,598,897 | B1 * | 7/2003 | Patti | 280/507 |
| 6,813,912 | B1 * | 11/2004 | Ng et al. | 70/21 |
| 7,059,158 | B2 * | 6/2006 | Freeman | 70/34 |
| 2004/0040351 | A1 * | 3/2004 | Alcott | 70/63 |
| 2004/0112099 | A1 * | 6/2004 | Randall | 70/63 |

OTHER PUBLICATIONS

International Search Report and Written Opinion of the International Searching Authority from International Application No. PCT/US07/22876, mailed Aug. 4, 2008.

* cited by examiner

*Primary Examiner*—Lloyd A Gall
(74) *Attorney, Agent, or Firm*—Calfee, Halter & Griswold LLP

(57) ABSTRACT

A portable safe for assembly with an apertured member includes a safe housing and a safe door. The safe housing has an internal cavity extending to an access port, and at least one opening configured to align with at least one aperture of the apertured member. The safe door is securable to the housing to substantially block the access port. The safe door includes a locking mechanism having at least one locking member secured in a housing engaging position when the locking mechanism is in a locked condition. The at least one locking member is movable to a housing disengaging position when the locking mechanism is in an unlocked condition. The safe door further includes a lock interface that is selectively operable to move the locking mechanism from the locked condition to the unlocked condition.

18 Claims, 6 Drawing Sheets

MOUNTABLE SAFE

CROSS REFERENCE TO RELATED APPLICATIONS

This application claims the benefit of U.S. Provisional Patent Application Ser. No. 60/855,478, entitled "MOUNTABLE SAFE" and filed Oct. 31, 2006, and U.S. Provisional Patent Application Ser. No. 60/855,670, entitled "MOUNTABLE SAFE" and filed Oct. 31, 2006, the entire contents of both of which are incorporated herein by reference, to the extent that they are not conflicting with the present application.

BACKGROUND

Safes are used in many indoor and outdoor environments to restrict access to various items by providing an enclosure with a door or other such access port. The port includes a locking mechanism, such as, for example, a combination lock, padlock, or key operated latch, to limit access to the contents of the safe to one or more authorized users. Some applications may require secure storage of a smaller item, such as, for example, a key. One example of such a situation involves a key used to operate a vehicle or to gain access to a portion of a vehicle or structure attached to a vehicle, such as, for example, a trunk, trailer, or car top/cargo carrier. Where multiple users require access to such a key, it may be desirable to store the key on or near the vehicle with which the key is used. While keeping the key in an unsecured location would risk loss or theft of the key, compromising the lock with which the key is associated, conventional safes and other locking enclosures may be impractical or ineffective for securely storing the key. A larger locked enclosure, such as a storage shed, locker, or larger safe would not be portable, which would prevent availability of the key when the vehicle is in other locations. A smaller, more portable safe, if kept in a location where any potential authorized user may access it, may be at risk of loss or theft of the entire safe, along with its contents.

SUMMARY

The present application contemplates a portable safe configured to be secured to an apertured member, such as, for example, a trailer hitch receiver tube oil a vehicle. According to one inventive aspect, a portable safe utilizes the locking pin apertures provided in a conventional trailer hitch receiver tube to securely affix the safe to the receiver tube. In one embodiment, a portable safe is configured to be affixed to one side of the receiver tube, which may allow for further use of the receiver tube, for example, with a trailer hitch ball mount. In another embodiment, a portable safe is configured to be inserted in the receiver tube, which may further restrict access to the safe.

Accordingly, in one exemplary embodiment, a portable safe for assembly with an apertured member includes a safe housing and a safe door. The safe housing has an internal cavity extending to an access port, and at least one opening configured to align with at least one aperture of the apertured member. The safe door is securable to the housing to substantially block the access port. The safe door includes a locking mechanism having at least one locking member secured in a housing engaging position when the locking mechanism is in a locked condition. The at least one locking member is movable to a housing disengaging position when the locking mechanism is in an unlocked condition. The safe door further includes a lock interface that is selectively operable to move the locking mechanism from the locked condition to the unlocked condition.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

This Detailed Description of the Invention merely describes embodiments of the invention and is not intended to limit the scope of the specification in any way. Indeed, the invention as described is broader than and unlimited by the embodiments described herein, and the terms used have their full ordinary meaning.

According to an inventive aspect of the present application, a safe may be provided for mounting to a structure or member having an aperture, such as, for example, a mounting hole or channel. An exemplary safe includes a housing, an access port, a lockable safe door for substantially blocking the access port to restrict access to an internal cavity, and a mounting pin extending from the housing. The pin is configured to be inserted through the opening and secured to the structure, thereby affixing the safe to the structure. The pin may be affixed to the safe housing using many different arrangements, including, for example, fasteners, welding, adhesives, and integral machining of a pin extending from the housing.

In one embodiment, a pin may be loosely assembled with a safe housing, such that the housing is rotatable and/or pivotable about the pin for positioning of the housing with respect to the structure to which the safe is mounted. As an example, a pin may be inserted through a hole in the housing. By providing a laterally extending angled, crossing, or enlarged end portion on the end of the exemplary pin, this end of the pin may be retained in the housing (i.e., by preventing the end portion from passing through the enclosure hole). One exemplary pin is an L-shaped pin, such as a retainer pin for a trailer hitch, configured such that the "leg" of the pin is retained inside the housing. Another exemplary pin is a T-shaped pin, having a crossing portion affixed to an elongated shaft portion, with the crossing portion retained inside the housing.

Figure 1:
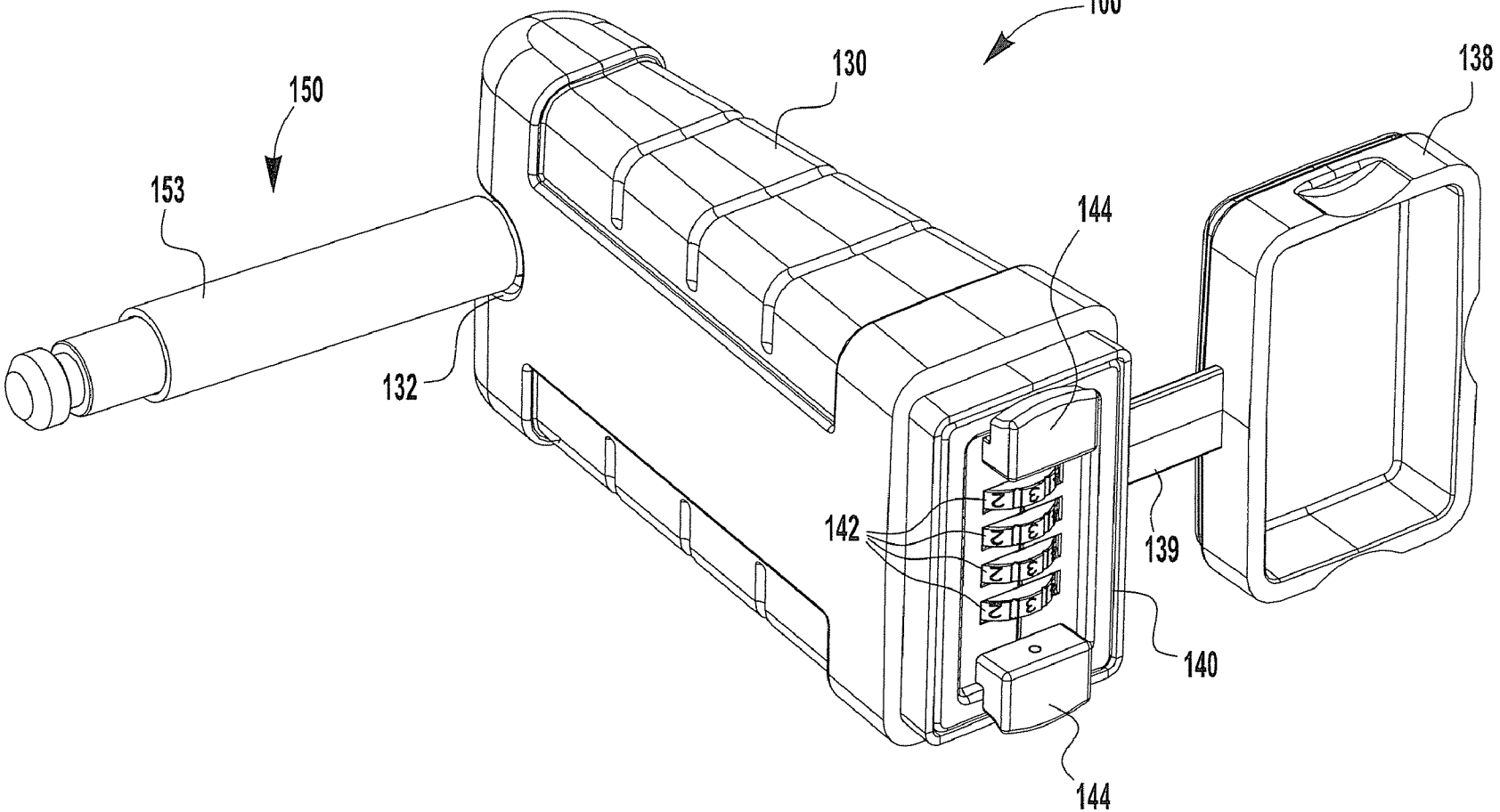
FIG. 1 is a perspective view of a mountable safe.
Figure 2:
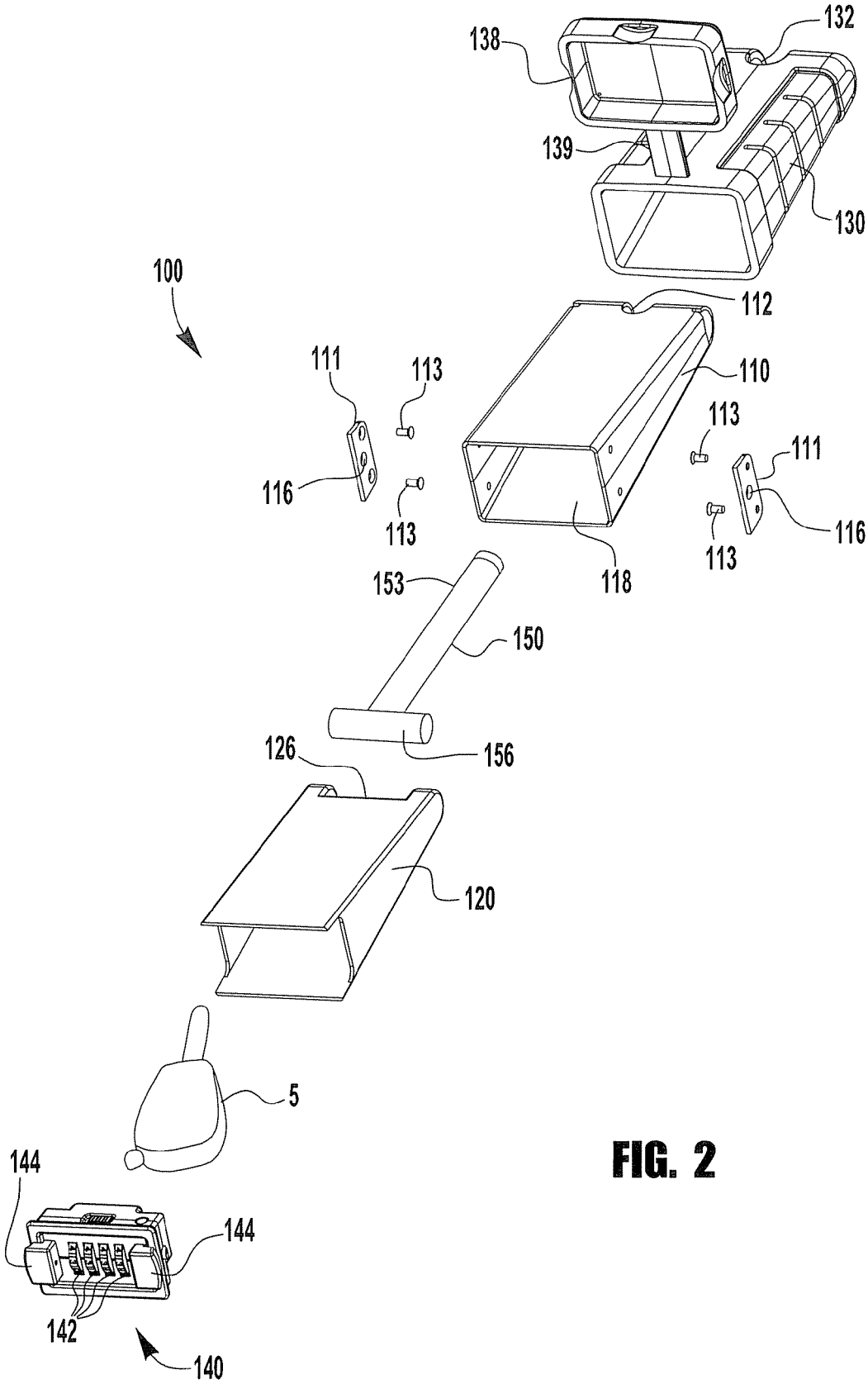
FIG. 2 is an exploded perspective view of the mountable safe of FIG. 1.
Figure 3:
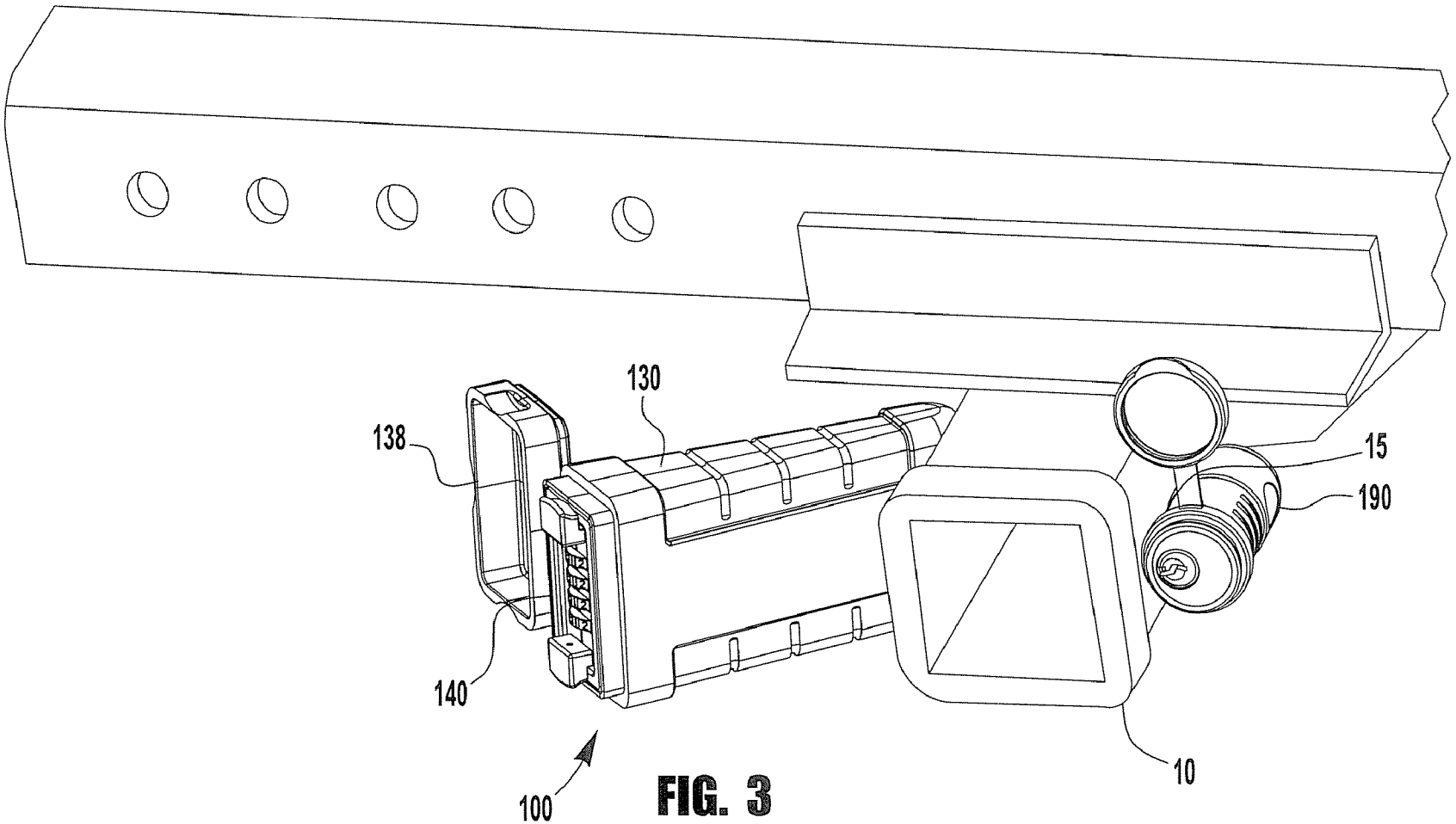
FIG. 3 is a perspective view of the mountable safe of FIG. 1 assembled with a trailer hitch receiver.
Figure 4:
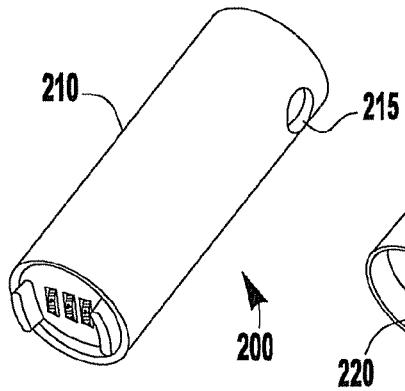
FIG. 4 is a front perspective view of another mountable safe.
Figure 5:
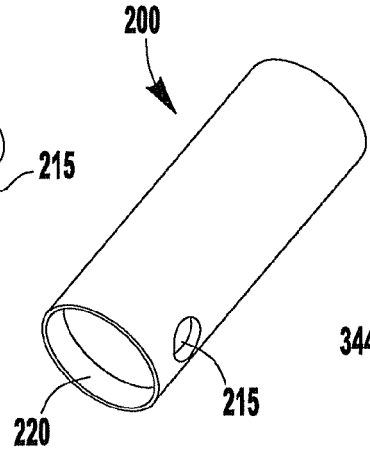
FIG. 5 is a rear perspective view of the safe of FIG. 4.

FIGS. 1-3 illustrate an exemplary embodiment of a safe 100 that is mountable to a structure 10 having one or more openings 15 configured to receive a pin or other such protrusion, such as, for example, the receiver pin openings 15 of a conventional trailer hitch receiver tube 10. The exemplary safe 100 includes a primary safe housing 110 configured to receive a mounting pin 150 having an elongated shaft portion 153 and a laterally extending leg portion 156. The shaft portion 153 passes through an opening 112 in the housing 110, while the leg portion 156 is retained within the housing 110. While the housing may be provided in many different materials, in one embodiment, it may be desirable to provide the housing in a durable, impact resistant material, such as, for example, steel, that would resist damage caused by accidental impacts or tampering. In the illustrated example, the housing 110 is provided from a steel stamping, which may be joined to form the enclosure by, for example, welding or assembly with plates 111 and fasteners 113, as shown in FIG. 2.

While the safe housing 110 may be provided in many different shapes and sizes, the wedge or "cowbell" shape of the illustrated embodiment provides a compact enclosure sufficient to store smaller items, such as, for example, a key 5 (FIG. 2). Also, the narrow end of the wedge-shaped housing 110 may allow for pivoting adjustability of the safe 100 with respect to the structure 10 to which the safe is mounted. In the illustrated embodiment, the pin opening 112 in the housing 110 is elongated to extend onto the sides of the housing 110, allowing the narrow end of the housing to pivot on the receiver pin 150. This may facilitate discrete positioning of the safe 100, as well as adjustment of the safe position when the safe 100 needs to be accessed for opening.

To provide lockable access to the contents of the safe 100, a safe door 140 may be provided for assembly with the housing 110 to cover or substantially block an access port 118 through which items may be inserted into, or removed from, the internal cavity of the safe. In a locked condition, the safe door 140 may be secured to the housing 110 to prevent access to the internal cavity of the safe 100. In an unlocked condition, the safe door 140 may be moved away from the access port 118, such as, for example, by opening the safe door 140 or by removing the safe door 140 from the housing 110.

Many different locking mechanisms may be utilized to secure the safe door 140 to the housing 110 in the locked condition. In one embodiment, one or more latches or locking members may extend from the sides of the safe door 140 in the locked condition to securely engage the housing 110. For example, the housing 110 may be provided with recesses 116 (or slots, tabs, detents or other such structures) that retain extended locking members 146 to maintain the locked condition. When the locking mechanism is moved from the locked condition to the unlocked condition, the locking members 146 are moveable to disengage from the housing 110, such as, for example, by retracting the locking members 146 into the safe door 140. Disengagement of the locking members 146 from the housing may be automatic, such as by a spring loaded mechanism within the safe door 140. Alternatively, disengagement of the locking members from the housing may occur as a result of user manipulation of some feature on the safe door 140 or other portion of the safe 100, such as, for example, buttons or levers 144 in communication with the locking members 146, such that operation of the buttons or levers 144 retracts the locking members into the safe door 140.

Many different lock types may be incorporated into the safe door 140, including, for example, key operated locks and different types of combination locks. In an exemplary embodiment, a common key may be used to operate multiple safes that are mounted on multiple vehicles in a fleet. In another embodiment, a series of combination dials may be provided, such that movement of each of the dials to predetermined positions or orientations, thereby displaying an authorized combination, moves the locking mechanism to an unlocked condition and allows the at least one latch to disengage from the housing. In one such embodiment, each of the dials may include a recess or cut-out, either directly on the dial or on a component, such as a cam or hub, connected with the dial. When the dials are rotated or positioned in the authorized combination, the recesses align to allow a locking slide to move into engagement with the recesses, which causes the one or more locking members, which may be connected with the locking slide, to disengage from the housing.

Figure 2A:
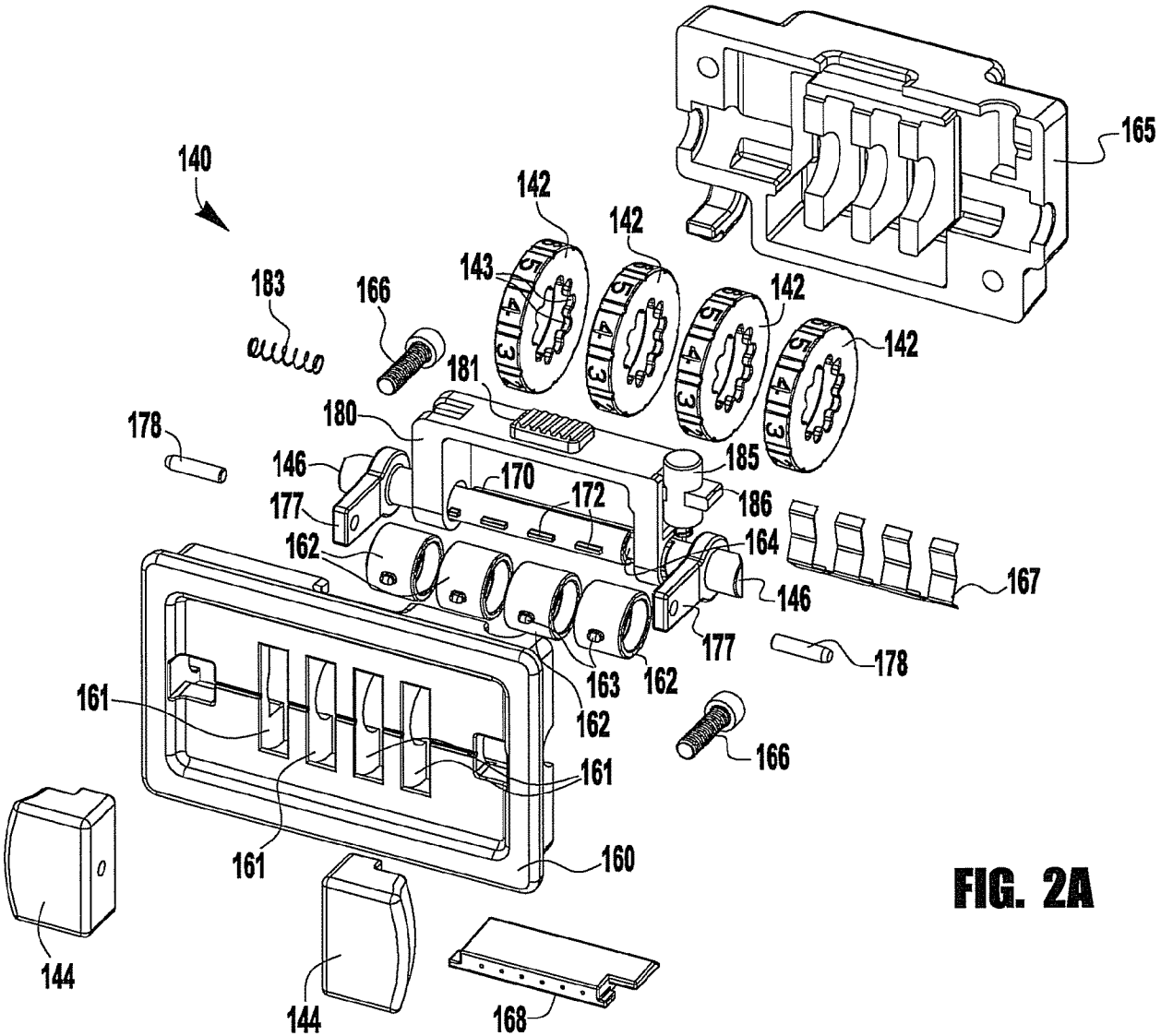
FIG. 2A is an exploded perspective view of the safe door of the mountable safe of FIG. 1.

In the illustrated embodiment, as shown in the exploded view of FIG. 2A, the safe door 140 includes front and rear casing portions 160, 165 secured together, for example, by fasteners 166 enclose the locking mechanism. A series of four numbered dials 142 are disposed in slots 161 in the front casing portion 160 such that a portion of each dial 142 is visible and graspable through the front of the safe door 140. The dials 142 include inner notches 143 that receive nibs 163 on corresponding hubs 162 for mutual rotation of the dials 142 and hubs 162 about a shaft 164. The hubs include internal slots (not shown) that align with ribs 172 on slide portions 170 of the locking members 146 when the dials 142 and hubs 162 are rotated to an authorized or proper orientation (corresponding with a predetermined authorized combination), thereby allowing the locking members 146 to be slidingly retracted into the safe door 140 when the buttons 144 (connected to the locking members 146 by plates 177 and pins 178) are squeezed laterally inward. Upon disengagement of the locking members 146 from corresponding notches or recesses 116 in the housing 110, the safe door 140 may be removed from the housing 110, and items may be inserted into, or removed from, the internal cavity of the safe 100. To re-lock the exemplary safe 100, the safe door 140 is placed back over the access port 118 of the housing 110. The locking members may be spring-loaded and chamfered to cause the locking members 146 to retract when the safe door 140 is pressed into the access port 118, and then snap outward when the locking members 146 are aligned with the safe housing recesses 116. Movement of at least one of the dials 142 out of the predetermined positions returns the locking mechanism to a locked condition, securing the safe door 140 on the housing 110. A spring plate 167, supported by a frame member 168, may also be included to provide the user with a positive, tactile indication of dial position, and to retain the dials 142 in a set position.

As shown in FIG. 2A, the safe door 140 may also be configured to facilitate a change of the authorized combination. A slide member 180 disposed on the shaft 164 includes a user graspable pad 181 that extends between the casing portions 160, 165. When the pad 181 and slide member 180 are slid by the user, the slide member 180 slides the hubs 162 out of engagement with the dials 142 (which remain fixed in the slots 161), allowing the dials 142 to be rotated to a new authorized combination. A spring loaded button 185 pops upward through an opening in the casing portions 160, 165 to hold the slide member 180 in the code changing position. When the button 185 is pressed, a flange portion 186 of the button 185 disengages the slide member 180, allowing spring 183 to return the slide member 180 to the secure position, re-engaging the hubs 162 with the dials 142 in the newly set orientation.

As shown in FIG. 2, to provide an environmental seal for the contents of the safe 100, the safe may further be provided with an inner sleeve 120, sized to fit inside the housing 110. The inner sleeve 120 may be provided to prevent exposure of the safe contents to moisture or other contaminants. The inner sleeve 120 may be provided with a step or recess 126 that aligns with the housing opening 112 when the inner sleeve 120 is installed in the housing 110, to secure the pin leg portion 156 between the housing 110 and the inner sleeve 120. The inner sleeve may be provided in many different materials, including for example, molded plastic.

The safe 100 may further be provided with an outer sleeve 130 sized to fit over the housing 110, for example, to provide a weatherproof seal, corrosion resistance, impact resistance, a softer surface for gripping or accidental impact, or improved aesthetic appearance of the safe. The outer sleeve 130 may be provided with an opening 132 that aligns with the housing opening 112 when the sleeve 130 is assembled with the housing 110, such that the pin 150 may extend through both the housing 110 and the outer sleeve 130. To provide more complete coverage of the safe, the safe 100 may be provided with a cap portion 138 which may be assembled over the safe door 140 to provide, for example, an environmental seal for the safe door 140 of the safe. While the cap portion 138 may be a separate component, in one embodiment, the cap portion may be integral with the sleeve 130, and/or may be attached to the sleeve 130 by a flap portion 139 or other such connection, which may prevent loss of the cap portion 138 when the cap portion is removed from the safe door 140.

As shown in FIG. 3, the exemplary safe may be assembled with the trailer hitch receiver tube 10 of a vehicle. The pin 150 used to mount the safe to the receiver may also be used to mount a trailer hitch, such as a ball mount trailer hitch (not shown), to the receiver tube 10, to allow a vehicle to tow an item. As the safe 100 is removable from the receiver tube by removing the pin 150 from the receiver holes 15, it may be desirable to provide a receiver pin lock 190, as known in the art, assembled to the inserted end of the pin 150, to prevent unauthorized removal or theft of the safe 100.

According to another inventive aspect of the present application, a portable safe may be configured to be secured within a hollow structure having one or more apertures, such as, for example, a conventional trailer hitch receiver tube. In one embodiment, a portable safe includes a housing sized to be at least partially received in the hollow structure, an internal cavity extending to an access port, a lockable safe door for substantially blocking the access port, and a pin extending from the housing. The pin is configured to be inserted through the aperture of the hollow structure, thereby affixing the safe to the structure. The pin may be affixed to the safe housing using many different arrangements, including, for example, fasteners, welding, adhesives, or a mechanism for securing the pin within the safe housing.

In one embodiment, a safe housing may be provided with openings that align with openings in a receiver tube in which the housing is received, such that a pin may be inserted through both the structure and the safe housing. In another embodiment, one or more pin members may extend from the housing, for example, from inside the housing, for insertion through openings in the receiver tube when the safe housing is received in the receiver tube. As an example, a safe may include retractable pin members that may be retracted during insertion of the safe housing into the receiver tube, and then extended through the openings of the structure once the safe housing is fully inserted. The exemplary pin members may be lockable in an extended condition, for example, by providing a user operated mechanism that is accessible only from inside the safe, to prevent unauthorized removal of the safe.

Figure 7:
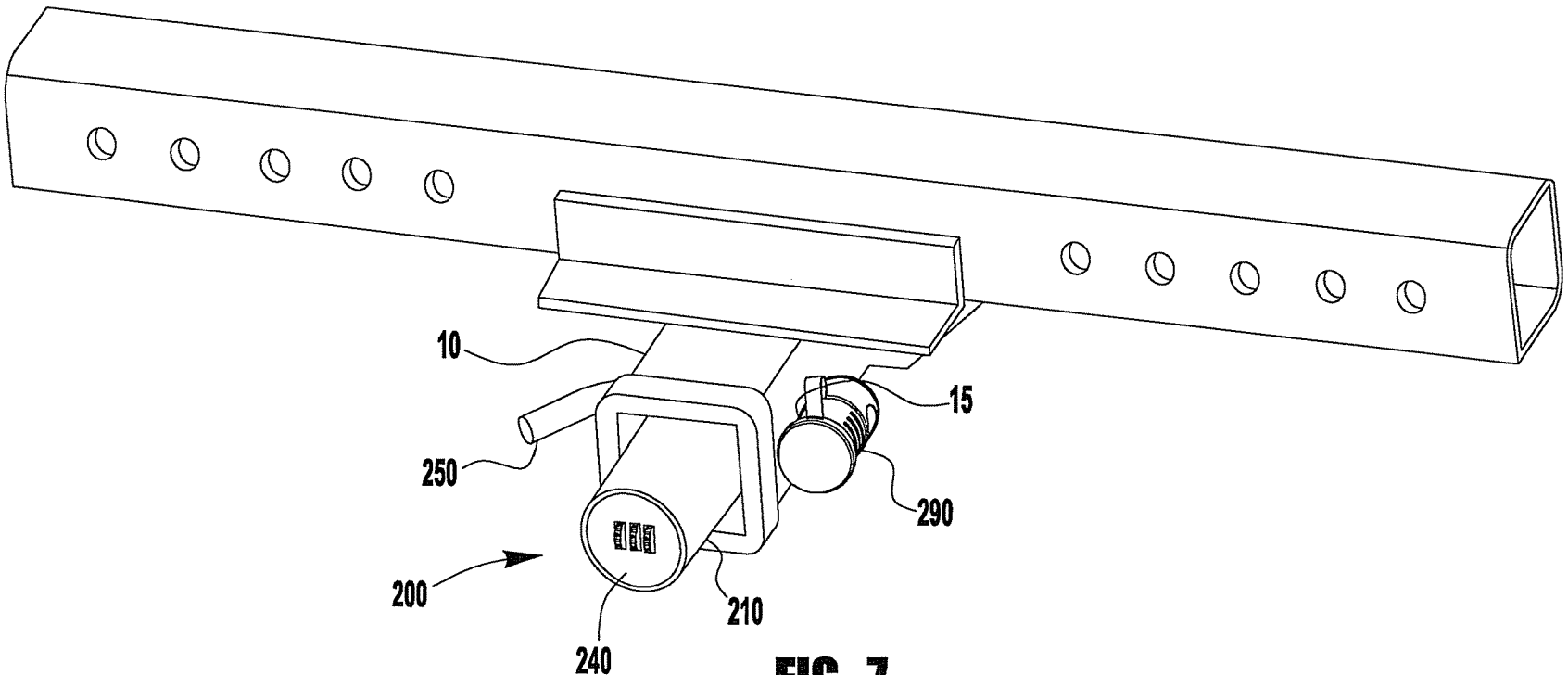
FIG. 7 is a perspective view of the safe of FIG. 4 assembled with a trailer hitch receiver.

FIGS. 4-7 illustrate an exemplary embodiment of a safe 200 that is mountable to a hollow structure 10 having a pair of aligned openings 15 configured to receive a pin or other such protrusion, such as, for example, the receiver pin openings 15 of a conventional trailer hitch receiver tube 10. The exemplary safe 200 includes a tubular housing 210 configured to receive a pin 250 (see FIG. 7). The pin 250 passes through aligned openings 215 in the housing 210, which align with corresponding openings 15 in the receiver tube 10 when the housing 210 is at least partially inserted in the receiver tube 10. Where access to the housing 210 is substantially blocked when inserted in a hollow structure 10 for mounting, the durability and impact resistance of the housing material may be less important. In other applications, where a portion of the housing 210 is exposed from the hollow structure 10, as shown in FIG. 7, a durable, impact resistant material, such as, for example, steel, may be desired. As one example, a housing may be constructed from a section of steel tube.

To provide lockable access to the contents of the safe 200, a lock door or safe door 240 may be provided for assembly with the housing 210 to cover an access port 218 through which items, such as a key 5 (FIG. 6) may be inserted into, or removed from, the safe. In a locked condition, the safe door 240 may be secured to the housing 210 to prevent access to the safe 200. In an unlocked condition, the safe door 240 may be moved away from the access port 218, such as, for example, by opening the safe door 240 or by removing the safe door 240 from the housing 210.

Many different locking mechanisms may be utilized to secure a safe door 240 to a safe housing 210 in the locked condition. In one embodiment one or more latches may extend from the sides of the safe door 240 in the locked condition to securely engage the housing 210. For example, the housing 210 may be provided with slots, tabs, detents or other such structures that engage the extended latches to maintain the locked condition. When the locking mechanism is moved from the locked condition to the unlocked condition, the latch or latches are moveable to disengage from the housing 210, such as, for example, by retracting the latches into the safe door 240. Disengagement of the latches from the housing may be automatic, such as by a spring loaded mechanism within the safe door 240. Alternatively, disengagement of the latches from the housing may occur as a result of user manipulation of some feature on the safe door 240 or other portion of the safe 200, such as, for example, buttons or levers in communication with the latches, such that operation of the buttons or levers retracts the latches into the safe door 240.

Many different lock types may be incorporated into the safe door 240, including, for example, key operated locks and different types of combination locks. In one exemplary embodiment, a common key may be used to operate multiple safes that are mounted on multiple vehicles in a fleet. In another embodiment, a series of numbered dials may be provided, such that movement of each of the dials to predetermined positions or orientations, thereby displaying an authorized combination, moves the locking mechanism to an unlocked condition and allows the at least one latch to disengage from the housing. As one example, the combination locking mechanism may function substantially similarly to the combination locking mechanism of the safe door 140 of FIG. 2A, described in greater detail above.

To retain stored items in the safe housing 210, a rear enclosure may also be provided. In one embodiment, the rear enclosure may include a rear wall integral with the housing 210. In another embodiment, the rear enclosure may include a cap assembled with the housing 210. Since the rear end of the safe 200 may not be accessible when the safe 200 is secured in the receiver tube 10, the cap may simply be assembled with the housing 210, such as by threading, fasteners, or a press fit arrangement. In the illustrated embodiment, a cap or sleeve portion 220 is press fit into the housing 210 to block the rear of the housing 210. The cap portion 220 may be provided with openings 225 that align with the openings 215 in the housing to allow for insertion of the pin 250, which in turn retains the cap portion 220 on the housing 210 while the pin 250 is inserted. Further, to provide an environmental seal for the contents of the safe 200, the cap portion may include a sheath 227 disposed between the openings that is sized to receive the pin 250, which provides a seal between the housing openings 215 and the storage area within the housing 210. The cap portion 220 may be provided in many different materials, including for example, molded plastic, which may facilitate construction of the sheath 227.

As shown in FIG. 7, the exemplary safe 200 may be assembled with the trailer hitch receiver 10 of a vehicle. As the exemplary safe 200 is removable from the receiver by removing the pin 250 from the receiver holes 15, it may be desirable to provide a receiver pin lock 290, as known in the art, assembled to the inserted end of the pin 250, to prevent unauthorized removal or theft of the safe 200.

Figure 8:
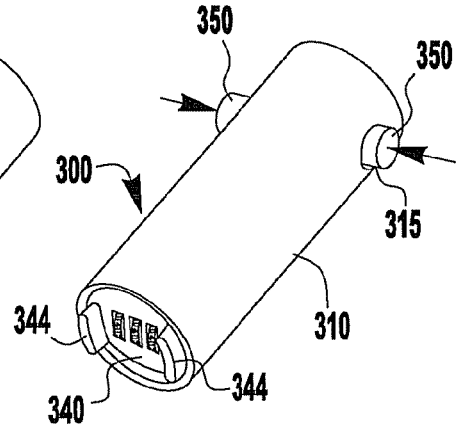
FIG. 8 is a perspective view of another mountable safe.
Figure 6:
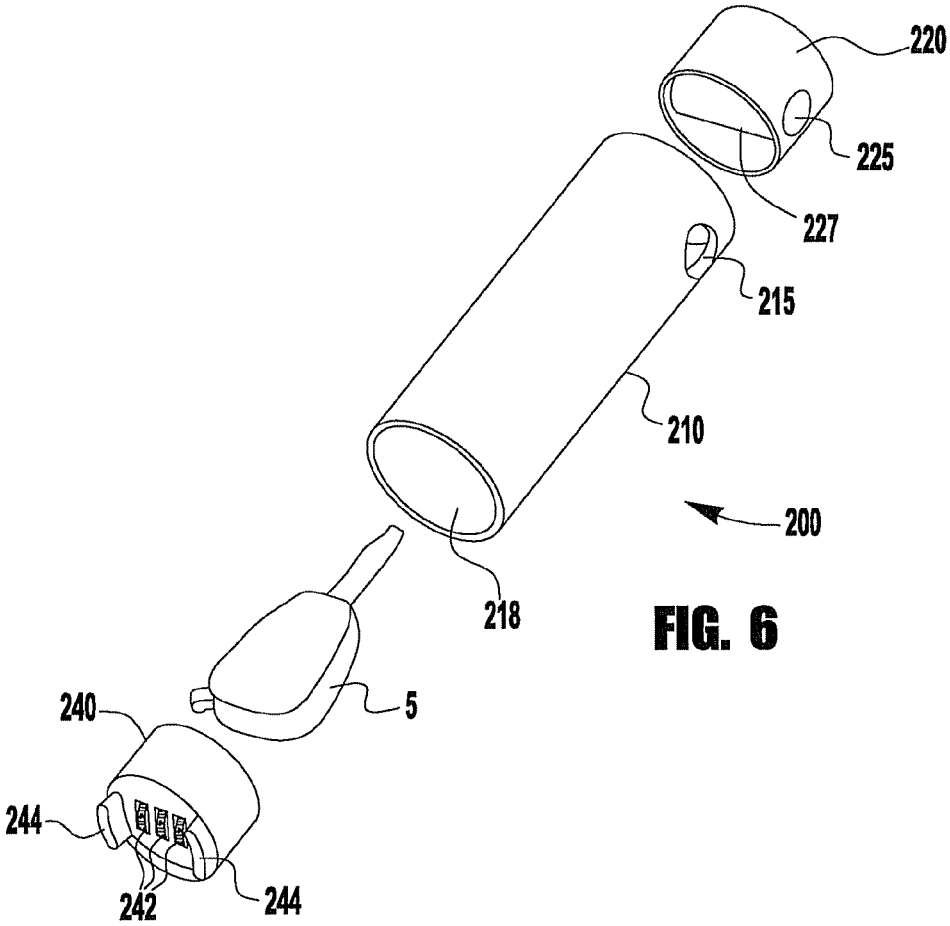
FIG. 6 is an exploded perspective view of the safe of FIG. 4.

According to another inventive aspect of the present application, a mountable safe may be secured within a hollow structure by providing one or more retractable pin members that extend from the safe housing to be received in corresponding openings in the hollow structure, which may eliminate the need for a separate pin for insertion through the safe housing and hollow structure. One such exemplary safe 300 is illustrated in FIG. 8, in which retracting pins 350 extend from openings 315 in the safe housing 310 for engagement with corresponding openings in a hollow structure. In one embodiment, the retracting pins 350 may be spring loaded, such that the pins may be compressed to allow insertion of the safe 300 into the hollow structure. When the spring loaded pins 350 are aligned with the corresponding openings in the hollow structure, such as, for example, a trailer hitch receiver tube or the frame member of a bicycle rack (not shown), the pins spring back to an extended position, thereby securing the safe 300 in the hollow structure. To prevent unauthorized removal of the installed safe 300, an obstruction may be positioned over one or both of the pins 350 to prevent compression of the pins. In another embodiment, the pins 350 may be lockable in an extended condition, and the safe 300 may be provided with a user operated mechanism, such as, for example, buttons, levers, or tabs, that may only be operated when the locking mechanism of the safe door 340 (which may be functionally similar to the safe door 140 of the embodiment shown in FIGS. 1-3) is in an unlocked condition. For example, the user operated mechanism may be positioned inside the safe housing 310, or the user operated mechanism may include or be connected with buttons 344 used to open the safe door 340. Other examples of locking pin-type mechanisms are described in U.S. Pat. No. 7,066,483, entitled "Integral Locking Coupler," the entire disclosure of which is incorporated herein by reference, to the extent it is not conflicting with the present application. As another example (not shown), the safe door may include prongs, posts, or other such extensions that block retraction of the pins when the safe door is received in the access port.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A portable safe for assembly with a trailer hitch receiver tube, the safe comprising:

a safe housing having an internal cavity extending to an access port, and at least one opening configured to align with at least one aperture of a receiver tube;

a mounting pin having an elongated shaft extending outward through an opening in the safe housing for insertion through at least one aperture of a receiver tube, and a laterally extending leg retained within the safe housing, wherein the safe housing is pivotable about the laterally extending leg; and a safe door securable to the housing to substantially block the access port, the safe door comprising:

a locking mechanism comprising at least one locking member secured in a housing engaging position when the locking mechanism is in a locked condition, the at least one locking member being movable to a housing disengaging position when the locking mechanism is in an unlocked condition; and a lock interface selectively operable to move the locking mechanism from the locked condition to the unlocked condition.

2. The portable safe of claim 1, wherein the safe door is removable from the safe housing when the at least one locking member is in the housing disengaging position.

3. The portable safe of claim 1, wherein the lock interface comprises a plurality of combination dials, wherein rotation of the dials to an authorized combination moves the locking mechanism to the unlocked condition.

4. The portable safe of claim 1, wherein the lock interface comprises at least one user operable button configured to move the at least one locking member to the housing disengaging position when the locking mechanism is in an unlocked condition.

5. The portable safe of claim 1, further comprising a sleeve member at least partially disposed within the safe housing, the sleeve member being configured to provide a seal between the internal cavity and the at least one opening of the safe housing.

6. The portable safe of claim 1, wherein the laterally extending leg of the mounting pin is prevented from passing through the at least one opening of the safe housing.

7. The portable safe of claim 1, further comprising a pin locking mechanism configured to be lockingly secured to an outermost end of the elongated shaft of the mounting pin to prevent withdrawal of the mounting pin from the at least one aperture.

8. The portable safe of claim 1, wherein the safe housing is wedge shaped, with the at least one opening of the safe housing being disposed at a narrow end of the wedge shaped housing.

9. The portable safe of claim 8, wherein the at least one opening of the safe housing extends across the entire narrow end of the housing and onto at least one of first and second side walls.

10. The portable safe of claim 5, wherein the sleeve member at least partially surrounds the internal cavity and separates a portion of the mounting pin from the internal cavity.

11. The portable safe of claim 1, wherein the mounting pin leg is substantially perpendicular to the mounting pin shaft.

12. A portable safe for assembly with a receiver tube, the safe comprising:

a safe housing having an internal cavity extending to an access port;

a sleeve disposed within the safe housing, the sleeve at least partially surrounding the internal cavity;

a safe door securable to the housing to substantially block the access port, the safe door comprising:

a locking mechanism comprising at least one locking member secured in a housing engaging position when the locking mechanism is in a locked condition, the at least one locking member being movable to a housing disengaging position when the locking mechanism is in an unlocked condition; and a lock interface selectively operable to move the locking mechanism from the locked condition to the unlocked condition; and a mounting pin having a first end portion extending outward through an opening in the safe housing for insertion through at least one aperture of a receiver tube, and a second end portion secured between an internal surface of the safe housing and an outer surface of the sleeve.

13. The portable safe of claim 12, wherein the safe housing is pivotable about the second end portion of the mounting pin.

14. The portable safe of claim 12, wherein the safe housing is wedge shaped, with the opening of the safe housing being disposed at a narrow end of the wedge shaped housing.

15. The portable safe of claim 14, wherein the opening of the safe housing extends across the entire narrow end of the housing and onto one of first and second side walls.

16. A method of securing a portable safe to a vehicle having a trailer hitch receiver tube, the method comprising:

providing a safe comprising a safe housing having an internal cavity extending to an access port; a safe door lockingly securable to the housing to substantially block the access port; and a mounting pin having an elongated shaft extending outward from the safe housing; the safe door lockingly securable to the safe housing independent of the mounting pin;

inserting the mounting pin through aligned first and second apertures in the receiver tube, such that the safe housing engages an outer surface of the receiver tube; and affixing a retaining member to a distal end of the mounting pin to prevent withdrawal of the mounting pin from the receiver tube apertures.

17. The method of claim 16, wherein affixing a retaining member to a distal end of the mounting pin comprises lockingly securing a pin lock to the distal end of the mounting pin.

18. The method of claim 16, further comprising pivoting the safe housing about an axis substantially perpendicular to the elongated shaft to position the safe housing in a desired orientation.

* * * * *